US007814618B2

(12) United States Patent
Lautenschläger

(10) Patent No.: US 7,814,618 B2
(45) Date of Patent: Oct. 19, 2010

(54) FURNITURE HINGE

(75) Inventor: Horst Lautenschläger, Reinheim (DE)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 367 days.

(21) Appl. No.: 11/945,320

(22) Filed: Nov. 27, 2007

(65) Prior Publication Data

US 2008/0271294 A1 Nov. 6, 2008

(30) Foreign Application Priority Data

May 3, 2007 (DE) ..... 10 2007 021 143
Jun. 5, 2007 (DE) ..... 10 2007 026 211

(51) Int. Cl.
*E05F 1/08* (2006.01)

(52) U.S. Cl. ..... 16/286; 16/50; 16/54; 16/58; 16/60; 16/250; 16/277; 16/319; 16/374

(58) Field of Classification Search ..... 16/50, 16/54, 58, 60, 250, 277, 286, 319, 374
See application file for complete search history.

(56) References Cited

U.S. PATENT DOCUMENTS

| | | | | |
|---|---|---|---|---|
| 4,197,612 | A * | 4/1980 | Zernig | 16/277 |
| 4,716,622 | A * | 1/1988 | DeBruyn | 16/297 |
| 4,908,907 | A * | 3/1990 | Rock et al. | 16/240 |
| 4,914,782 | A * | 4/1990 | Rupprechter | 16/319 |
| 5,056,189 | A * | 10/1991 | Brustle et al. | 16/235 |
| 6,591,454 | B2 * | 7/2003 | Brustle | 16/374 |
| 2004/0200034 | A1 * | 10/2004 | Salice | 16/84 |
| 2004/0205935 | A1 * | 10/2004 | Lautenschlaeger et al. | 16/374 |
| 2005/0071953 | A1 * | 4/2005 | Salice | 16/285 |
| 2005/0144758 | A1 * | 7/2005 | Herper et al. | 16/277 |
| 2005/0155180 | A1 * | 7/2005 | Lin | 16/287 |
| 2005/0177980 | A1 * | 8/2005 | Herper | 16/366 |

* cited by examiner

*Primary Examiner*—Victor Batson
*Assistant Examiner*—Roberta Delisle
(74) *Attorney, Agent, or Firm*—Carlson, Gaskey & Olds PC

(57) ABSTRACT

An example furniture hinge includes a saddle supporting the damping cylinder that engages a first mounting edge of the supporting arm from behind. A locking element supported movably on the saddle has a laterally protruding mounting lug, which in a locking position engages a second mounting edge of the supporting arm from behind. The second mounting edge is oriented counter to the first mounting edge.

19 Claims, 4 Drawing Sheets

FURNITURE HINGE

CROSS REFERENCE TO RELATED APPLICATIONS

This application claims priority to German Patent Application No. 10 2007 026 211.8, which was filed on 5 Jun. 2007, and to German Patent Application No. 10 2007 021 143.2, which was filed on 3 May 2007.

BACKGROUND OF THE INVENTION

The invention relates to securing a furniture hinge having a damping device.

Some furniture hinges include damping devices for damping the motion of the furniture door at the end of a door closing motion. The damping devices lessen the forces that the door exerts on a furniture body when the hinges close. Damping devices often include a damping cylinder having a piston joined to a piston rod extending from the damping cylinder. The piston rod contacts a door stop part or the furniture door and brakes motion as the furniture door closes.

In such furniture hinges, the damping device is detachably attached to the supporting arm. The damping cylinder is secured by engaging an opening in the supporting arm. The snap-type connection between the damping device and the supporting arm may undesirably loosen or separate under relatively high, persistent loads.

SUMMARY

An example furniture hinge includes a saddle supporting the damping cylinder that engages a first mounting edge of the supporting arm from behind. A locking element supported movably on the saddle has a laterally protruding mounting lug, which, in a locking position, engages a second mounting edge of the supporting arm from behind. The second mounting edge is oriented counter to the first mounting edge.

The anchoring by positive engagement of the damping device on two oppositely oriented mounting edges of the supporting arm produces a positive connection which is suitable for transmitting relatively major forces. The edges of the supporting arm may be located inward against one another or outward in opposing directions.

In another example furniture hinge, the saddle, with a respective outer wall, fits over two diametrically opposed side walls of the supporting arm to securely center the saddle on the supporting arm.

In one example furniture hinge, the saddle underside has a fastening protrusion, which protrudes in centering fashion into a window in the supporting arm. An inner edge of the window forms the first mounting edge that is engaged from behind by a lateral, undercut mounting strip of the fastening protrusion. The diametrically opposed inner edge of the window forms the second mounting edge.

Little or no modifications to the window of the conventional furniture hinges are needed. Thus the damping device can be placed on existing supporting arms. The anchoring in the window of the supporting arm produces a connection that is suitable for transmitting major forces.

Another example furniture hinge includes a saddle that fits in hook-like fashion over an outer edge on the supporting arm. The outer edge forms the first mounting edge, and another diametrically opposed outer edge forms the second mounting edge of the supporting arm.

The locking elements within the example hinges are locking pegs, supported on the saddle. The peg, near an end protruding from the underside of the saddle, has the laterally radially protruding mounting lug. which is movable to behind the second mounting edge of the supporting arm upon a motion of the locking peg.

Such locking elements occupy only little space, yet it are equally suitable for transmitting a major mounting force. A Phillips screwdriver may actuate the locking element in some examples.

BRIEF DESCRIPTION OF THE DRAWINGS

These and other features of the present invention can be best understood from the following specification and drawings, the following of which is a brief description.

DETAILED DESCRIPTION OF THE PREFERRED EMBODIMENT

Figure 1:
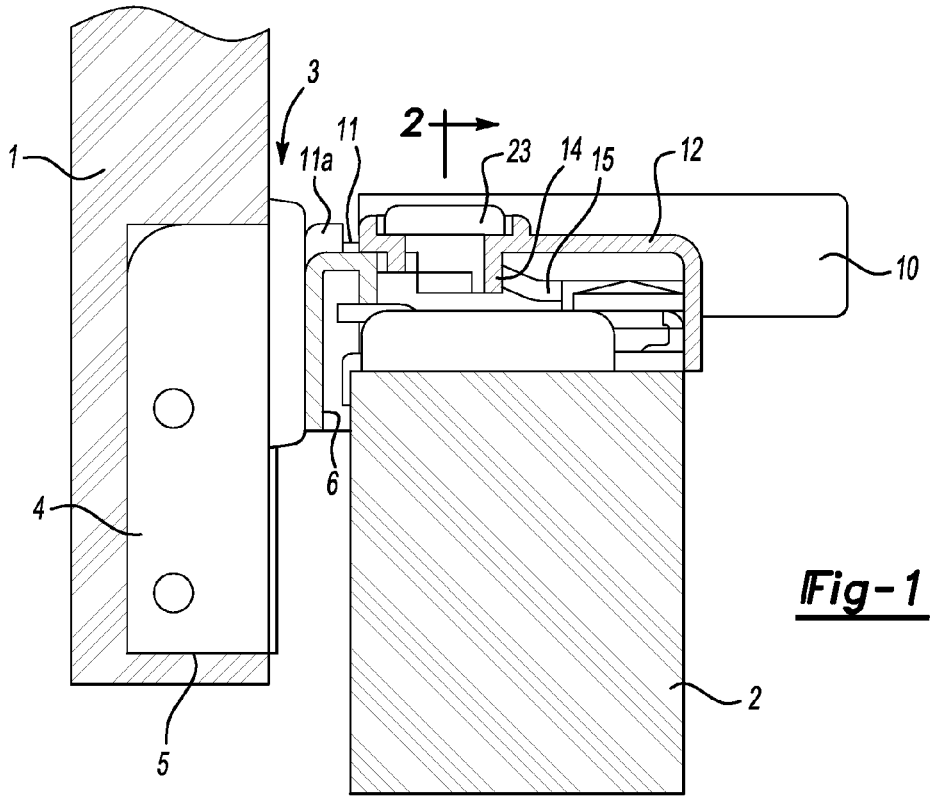
FIG. 1 shows a sectional view of an example furniture hinge having a damping device.
Figure 2:
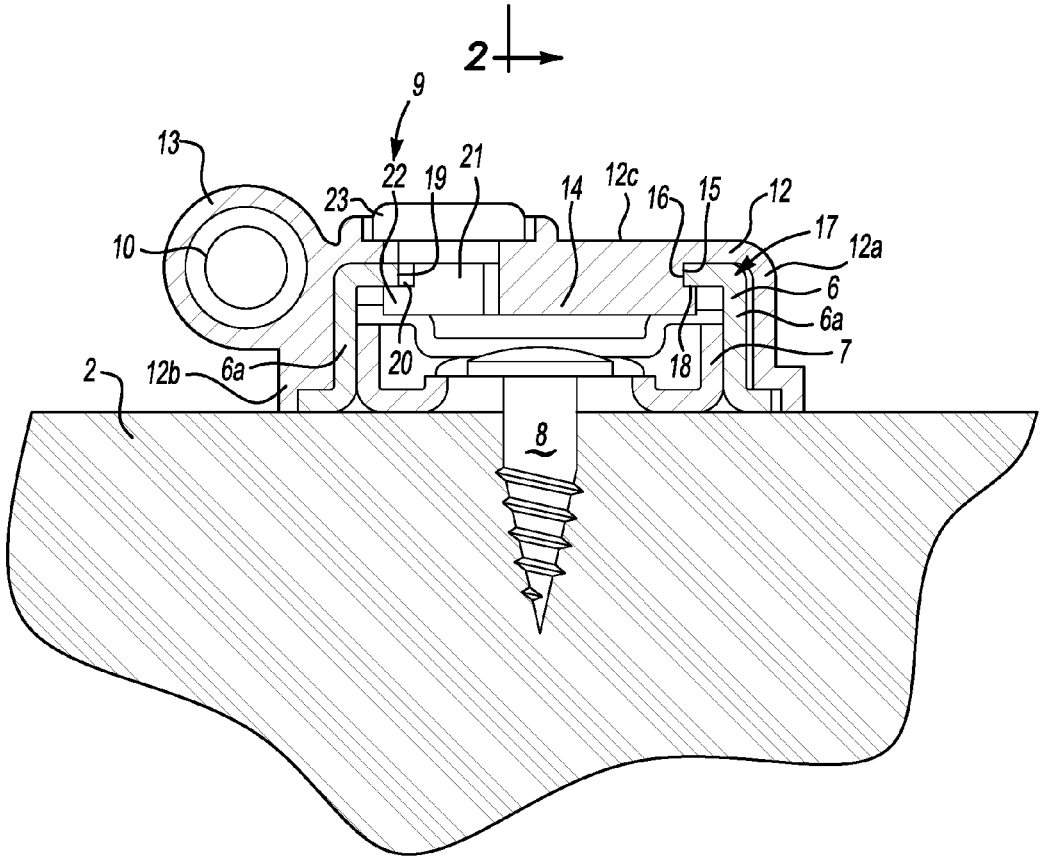
FIG. 2 shows a sectional view of the FIG. 1 hinge taken along the line II-II in FIG. 1.

As shown in FIGS. 1 and 2, an example furniture hinge pivotably connects a furniture door 1 to a body 2 of a piece of furniture. A door stop portion 3 of the furniture hinge includes an inserted cup 4 for receipt within a cup bore 5 of the furniture door 1. The door stop portion 3 is pivotably supported at least one joint on a supporting arm 6.

In an example multi-joint hinge, two connecting rods connect the supporting arm 6, on its joint end, to the door stop portion 3. The end of the supporting arm 6 near the body of a piece of furniture adjustably mounts on a mounting plate 7 screwed to the front frame of the body 2 of a piece of furniture by at least one fastening member, such as a screw 8.

A damping device 9 has a damping cylinder 10, whose piston rod 11, with its head 11*a*, meets a lateral flange of the door stop portion 3 at the end of the closing motion of the furniture door 1 in order to damp the closing motion of the furniture door 1 at the end of the closing stroke.

The damping cylinder 10 mounts laterally on a saddle 12. In this example, the saddle 12 is integrated with a housing 13 that receives the damping cylinder 10.

The saddle 12 fits, with a respective outer wall 12*a*, 12*b*, over two diametrically opposed side walls 6*a* of the supporting arm 6.

Figure 5:
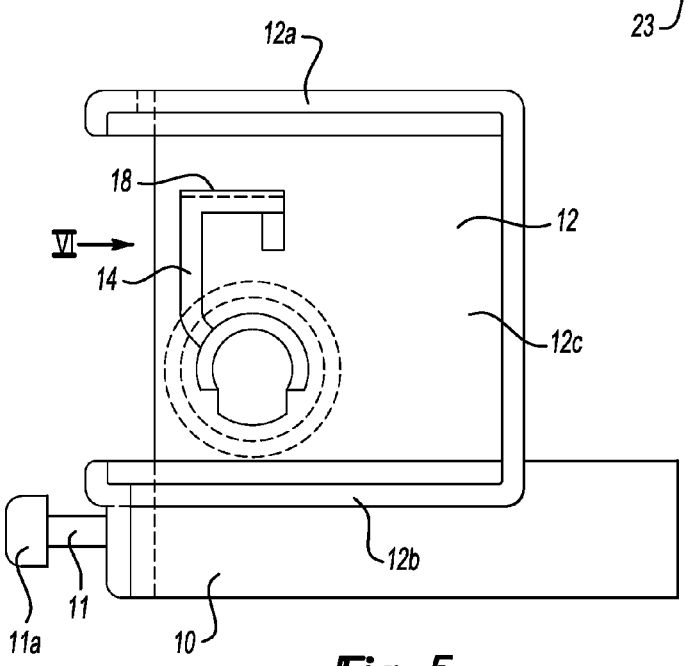
FIG. 5 shows a another view of the FIG. 3 locking peg along the direction of the arrow V in FIG. 3.
Figure 6:
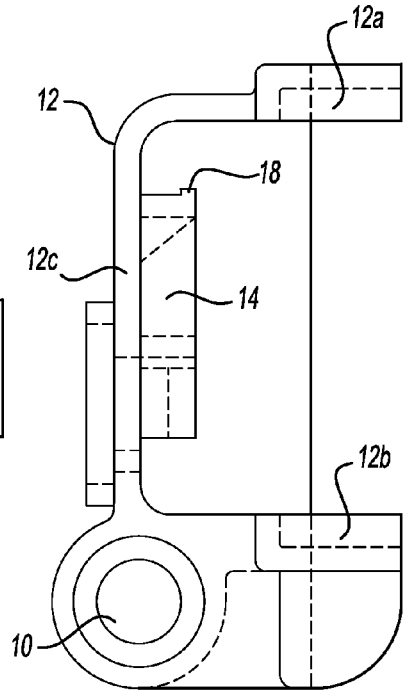
FIG. 6 shows a side view of the FIG. 3 locking peg along the direction of the arrow VI in FIG. 5.
Figure 7:
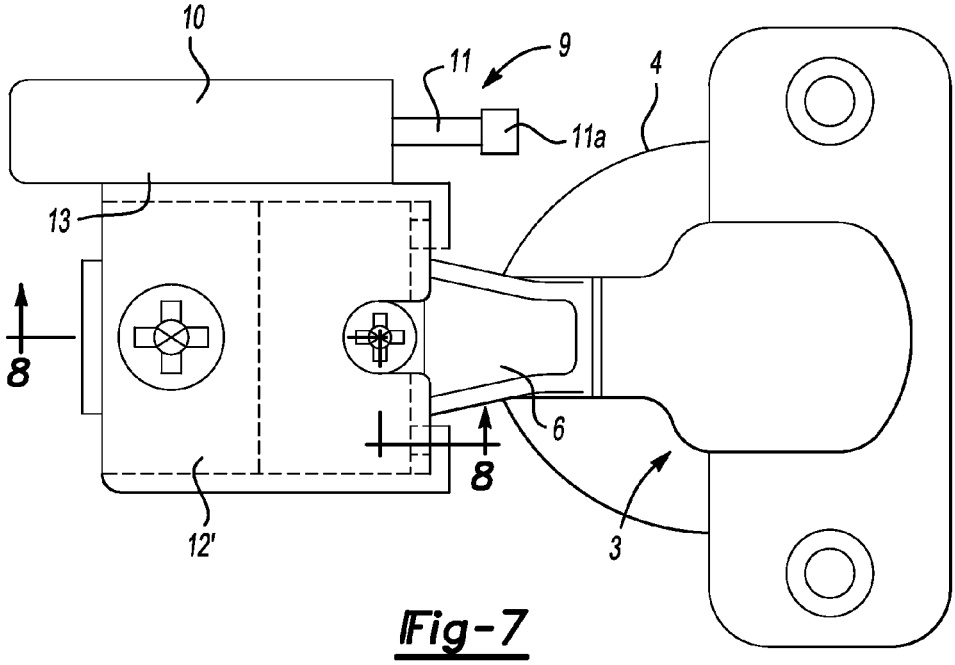
FIG. 7 shows a top view of another example furniture hinge with a damping device.
Figure 8:
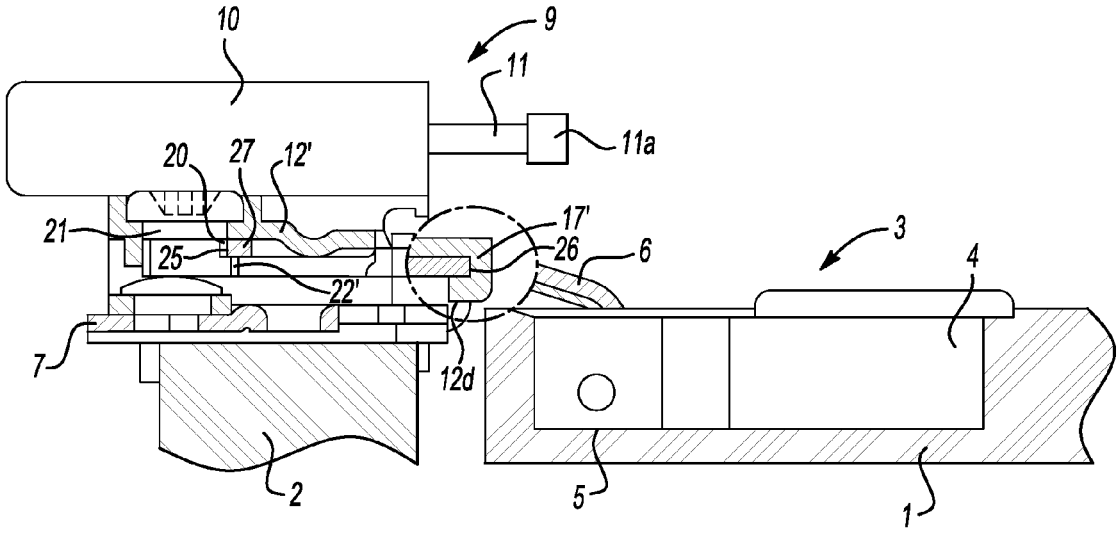
FIG. 8 shows a sectional view of the FIG. 7 furniture hinge taken along the line VIII-VIII in FIG., 7.
Figure 9:
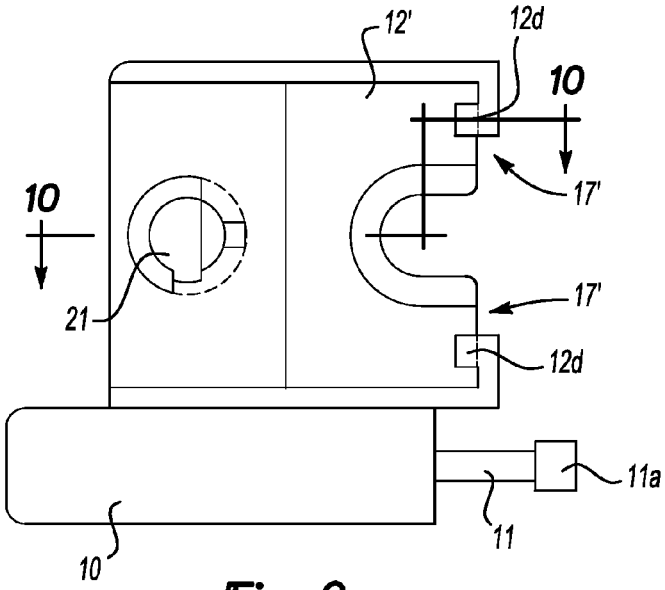
FIG. 9 shows another view of the FIG. 7 furniture hinge saddle from below the damping device in FIG. 7.
Figure 11:
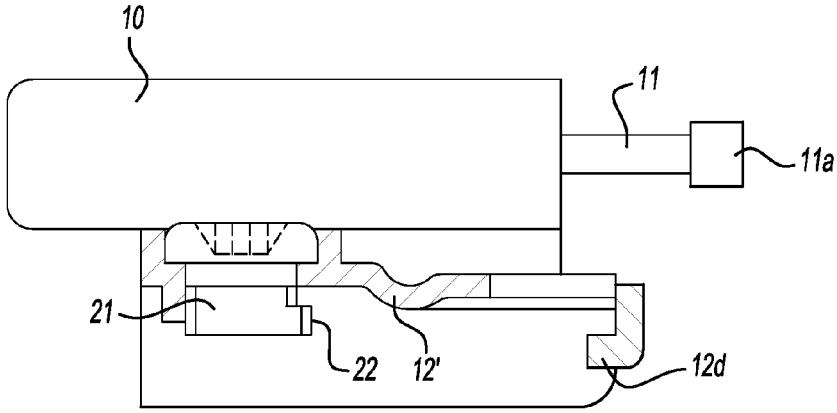
FIG. 11 shows a top view of an example furniture hinge supporting arm for receiving the saddle of FIG. 10.
Figure 10:
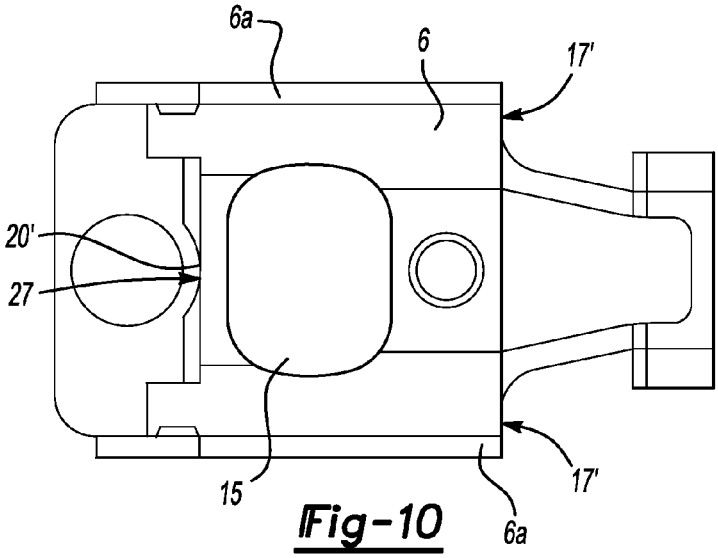
FIG. 10 shows a sectional view of the FIG. 9 furniture hinge saddle taken along the line X-X in FIG. 9.

On the underside of its upper wall 12*c*, the saddle 12 has a fastening protrusion 14, which protrudes in centering fashion into a window 15 in the supporting arm 6. An inner edge 16 of the window 15 forms a first mounting edge 17, which is engaged from behind by a lateral, undercut mounting strip 18 of the fastening protrusion 14, as shown in FIGS. 5 and 6. The diametrically opposed inner edge 19 of the window 15 forms a second mounting edge 20.

Figure 3:
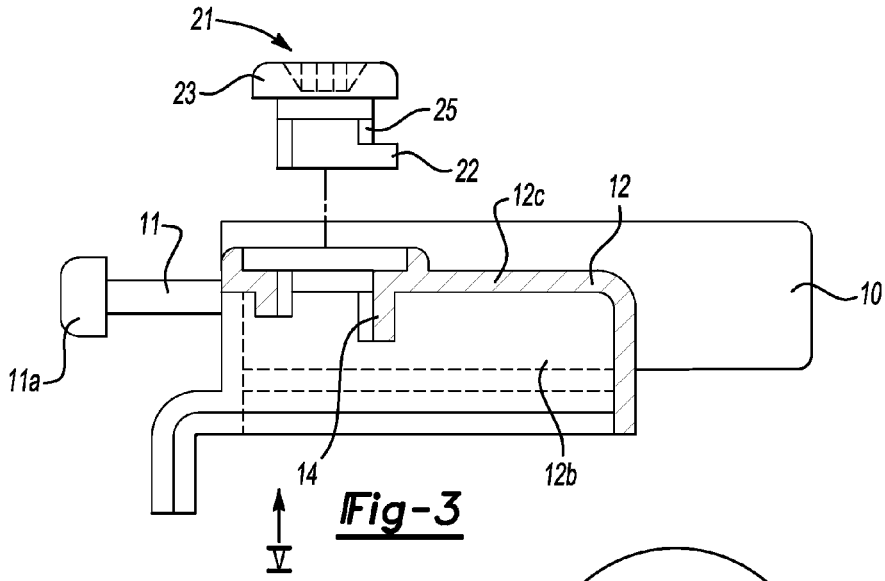
FIG. 3 shows a sectional view of the saddle of the damping device with the lacking peg removed.
Figure 4:
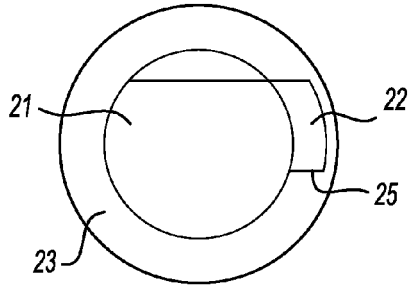
FIG. 4 shows a front view of the FIG. 3 locking peg.

The saddle 12 rotatably supports a locking peg 21 having an axis of rotation extending perpendicular to the plane of the saddle 12. On an end of the locking peg 21 protruding out of the underside of the saddle 12, the locking peg 21 has a radially protruding mounting lug 22, as shown in FIGS. 3 and 4. Moving the locking peg 21 facilitates moving the locking peg 21 behind the second mounting edge 20 of the supporting arm 6.

On the top side of the saddle 12, the locking peg 21 has a widened peg head 23 having a tool engagement feature, which in this example is a Phillips screw slot 24. The locking peg 21 can thus be rotated by a Phillips screwdriver into the locked position of FIG. 2, once the saddle part 22 has been placed on the supporting arm 6.

On a portion of the locking peg 21 away from the mounting lug 22, the locking peg 21 has a radially ascending cam face 25. Moving the locking peg 21 presses the cam face 25 against the second mounting edge 20. Accordingly, the fastening protrusion 14 of the saddle 12 presses against the first mounting edge 17. Thus the saddle 12 is not only secured by positive engagement against lifting away from the supporting arm 6 but also fixed in clamping fashion against lateral shifting.

In the example of FIGS. 1-6, a fastening protrusion 14 of the saddle 12 engages a window 15 of the supporting arm. In the example of FIGS. 7-11, the saddle 12' fits over an outer edge 26, forming the first mounting edge 17', on the supporting arm 6 in hook-like fashion (hook 12*d*). An outer edge 27 opposite the outer edge 26 forms the second mounting edge 20', which the mounting lug 22 engages from behind through the rotatable locking peg 21. Simultaneously, clamping is effected by the cam face 25 of the locking peg 21.

While in the embodiment of FIGS. 1-6, the clamping by means of the lacking peg 21 is effected transversely to the operative direction of the damping cylinder 10, in the embodiment of FIGS. 7-11 the locking peg 21 clamps in a direction that extends in the longitudinal direction of the supporting arm 6, and hence parallel to the lateral guidance between the outer walls 6*a*, 12*a* and 6*a*, 12*b*.

Although a preferred embodiment of this invention has been disclosed, a worker of ordinary skill in this art would recognize that certain modifications would come within the scope of this invention. For that reason, the following claims should be studied to determine the true scope and content of this invention.

The invention claimed is:

1. A furniture hinge assembly comprising:

a supporting arm securable to a furniture body, said supporting arm having outwardly facing portions and opposing inwardly facing portions relative to the furniture body;

a door stop portion pivotably supported on a joint end of said supporting arm;

a damping device housing;

a saddle at least partially supporting said damping device housing and configured to contact some of said inwardly facing portions to engage said saddle with said supporting arm; and a locking element rotatably supported on said saddle and having a mounting feature configured to contact some of said inwardly facing portions when in a locked position to engage said saddle with said supporting arm.

2. The furniture hinge assembly of claim 1 wherein said saddle includes a plurality of outer walls that fit over opposing side walls of said supporting arm.

3. The furniture hinge assembly of claim 1 wherein an underside of said saddle includes a protrusion for extending into a window within said supporting arm assembly to center said saddle.

4. The furniture hinge assembly of claim 3 wherein said supporting arm includes a first inner edge and a second inner edge that together at least partially define said window, said first inner edge comprising a first mounting edge, and said second inner edge comprising a second mounting edge diametrically opposed to said first mounting edge.

5. The furniture hinge assembly of claim 1 wherein said supporting arm comprises a first mounting edge and a second mounting edge oriented counter to said first mounting edge.

6. The furniture hinge assembly of claim 5 wherein a lateral undercut mounting protrusion extends from an underside of said saddle to engage said first mounting edge.

7. The furniture hinge assembly of claim 5 wherein said saddle fits in hooklike fashion over a first outer edge, said first outer edge comprising said first mounting edge of said supporting arm assembly.

8. The furniture hinge assembly of claim 5 wherein said locking element is a locking peg supported on said saddle, said peg having a laterally radially protruding mounting lug on an end of said peg protruding from an underside of said saddle, said mounting lug moveable with said locking peg, said mounting lug moveable behind said second mounting edge of said supporting arm assembly.

9. The furniture hinge assembly of claim 8 wherein said locking peg comprises a circumferential portion located further from said end of said peg having said mounting lug than said mounting lug, said circumferential portion comprising a radially ascending cam face rotatable with said locking peg, said cam face pressing against said second mounting edge when rotated.

10. The furniture hinge assembly of claim 8 wherein said locking peg comprises a widened peg head on a top side of said saddle, said widened peg head having a tool engagement feature.

11. The furniture hinge assembly of claim 1 wherein said saddle fits in hooklike fashion over a portion of said supporting arm.

12. The furniture hinge assembly of claim 1 wherein said inwardly facing portions are directed toward the furniture body.

13. The furniture hinge assembly of claim 1 wherein said damping device housing is configured to receive a damping cylinder, a piston rod of said damping cylinder configured to contact said door stop portion as a furniture door supported by said door stop portion moves to a closed position.

14. The furniture hinge assembly as defined by claim 13 wherein the damping cylinder is located laterally on said saddle when received within said damping device housing.

15. A furniture hinge assembly comprising:

a supporting arm securable to a furniture body, said supporting arm having a first mounting edge area and a second mounting edge area oriented counter to said first mounting edge area;

a door stop portion pivotably supported on a joint end of said supporting arm;

a damping device mountable to said supporting arm;

a saddle at least partially supporting said damping device, said saddle configured to engage a portion of said first mounting edge area that faces the furniture body when said supporting arm is secured to the furniture body; and a locking element moveably supported on said saddle and having a mounting feature configured to engage a portion of said second mounting edge area that faces the furniture body when said supporting arm is secured to the furniture body.

16. The furniture hinge assembly of claim 15 wherein said mounting feature protrudes laterally relative to second mounting edge area.

17. The furniture hinge assembly of claim 15 wherein said mounting feature engages said second mounting edge area when in a locked position.

18. The furniture hinge assembly of claim 15 wherein said locking element is rotatably supported on said saddle.

19. The furniture hinge assembly of claim 15 wherein said saddle engages said first mounting edge area in a hooklike fashion.

* * * * *